US007665540B2

(12) United States Patent
Gross et al.

(10) Patent No.: US 7,665,540 B2
(45) Date of Patent: Feb. 23, 2010

(54) MULTISTAGE SOLENOID FASTENING DEVICE

(75) Inventors: Paul G. Gross, White Marsh, MD (US); Nathan J. Cruise, Phoenix, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 12/402,974

(22) Filed: Mar. 12, 2009

(65) Prior Publication Data

US 2009/0166393 A1 Jul. 2, 2009

Related U.S. Application Data

(62) Division of application No. 11/670,088, filed on Feb. 1, 2007, now Pat. No. 7,537,145.

(51) Int. Cl.
*B25C 5/15* (2006.01)
*B25C 1/06* (2006.01)

(52) U.S. Cl. ..... 173/2; 173/90; 173/11; 227/131

(58) Field of Classification Search ..... 227/131; 173/90, 2, 11; 82/577, 575
See application file for complete search history.

(56) References Cited

U.S. PATENT DOCUMENTS

| | | | |
|---|---|---|---|
| 1,767,926 | A | 6/1930 | Hoffman |
| 2,923,937 | A | 2/1960 | Laucher |
| 3,193,167 | A | 7/1965 | Newton |
| 3,330,462 | A | 7/1967 | Colechia et al. |
| 3,353,737 | A | 11/1967 | Howard et al. |
| 3,389,355 | A | 6/1968 | Schroeder Jr. |
| 3,434,026 | A | 3/1969 | Doyle |
| 3,450,255 | A | 6/1969 | Mosetich |
| 3,486,095 | A | 12/1969 | Sherwood et al. |
| 3,524,576 | A | 8/1970 | Bader |
| 3,543,987 | A | 12/1970 | Obergfell et al. |
| 3,548,273 | A | 12/1970 | Parodi et al. |
| 3,552,627 | A | 1/1971 | Moreno |

(Continued)

FOREIGN PATENT DOCUMENTS

| | | | |
|---|---|---|---|
| CN | 2321594 | Y | 6/1999 |

(Continued)

OTHER PUBLICATIONS

Parts Reference Guide (SCN40R), Senco Products, Inc., Cincinnati, OH 45244, Revised Mar. 20, 2001.

*Primary Examiner*—Brian D Nash
(74) *Attorney, Agent, or Firm*—Harness, Dickey & Pierce, P.L.C.

(57) ABSTRACT

A method of driving a fastener into a workpiece with a tool generally includes retracting a trigger into a housing of the tool to execute a driver sequence and establishing a magnetic field in a multistage solenoid. The magnetic field is established in at least one of a first stage and a second stage. The method includes drawing an armature member to an extended condition from a retracted condition with the magnetic field and determining a position of the armature member relative to at least one of the first stage and the second stage. The method also includes directing power between the first stage and the second stage during the driver sequence based on the position of the armature member.

17 Claims, 9 Drawing Sheets

U.S. PATENT DOCUMENTS 3,558,031 A 1/1971 Hillier
RE27,101 E 3/1971 Maynard
3,568,908 A 3/1971 Bader
3,589,587 A 6/1971 Manganaro
3,622,062 A 11/1971 Goode, Jr. et al.
3,636,707 A 1/1972 Saari et al.
3,664,565 A 5/1972 Heilman
3,666,231 A 5/1972 Parodi et al.
3,672,029 A 6/1972 Butriss
3,688,966 A 9/1972 Perkins et al.
3,703,981 A 11/1972 Smith
3,708,097 A 1/1973 Fisher
3,786,286 A 1/1974 Palsson et al.
3,803,840 A 4/1974 Toczycki
3,858,780 A 1/1975 Perkins et al.
3,893,610 A 7/1975 Smith
3,924,789 A 12/1975 Avery et al.
3,945,551 A 3/1976 Sato et al.
4,005,812 A 2/1977 Doyle et al.
4,053,094 A 10/1977 Males
4,093,901 A 6/1978 Rose
4,106,972 A 8/1978 Caudill
4,149,297 A 4/1979 Monacelli
4,163,310 A * 8/1979 Sigmund ..... 29/407.02
4,163,311 A * 8/1979 Sigmund ..... 29/407.02
4,183,453 A 1/1980 Barrett et al.
4,230,249 A 10/1980 Nasiatka et al.
4,245,493 A * 1/1981 Lindell ..... 72/436
4,251,017 A 2/1981 Doyle et al.
4,270,687 A 6/1981 Mauer
4,293,088 A 10/1981 Barrett et al.
4,298,072 A 11/1981 Baker et al.
4,313,552 A 2/1982 Mauer
4,319,705 A 3/1982 Geist et al.
4,349,143 A 9/1982 Ewig
4,375,867 A 3/1983 Novak et al.
4,442,965 A 4/1984 Leistner
4,449,815 A 5/1984 Staffan
4,480,202 A 10/1984 Leutner et al.
4,491,260 A 1/1985 Jimena
4,518,109 A 5/1985 Shiroyama
4,524,897 A 6/1985 Bachmann
4,549,681 A 10/1985 Yamamoto et al.
4,556,803 A 12/1985 Weigert
4,565,313 A 1/1986 Buck et al.
4,570,904 A 2/1986 Mullally
4,573,621 A 3/1986 Merkator et al.
4,585,154 A 4/1986 Fealey et al.
4,597,517 A 7/1986 Wagdy
4,600,135 A 7/1986 Mukoyama
4,618,087 A 10/1986 Lai
4,656,400 A 4/1987 Pailthorp et al.
4,669,648 A 6/1987 Monacelli
4,687,054 A 8/1987 Russell et al.
4,784,308 A 11/1988 Novak et al.
4,821,614 A * 4/1989 Fleet et al. ..... 83/100
4,856,696 A 8/1989 Seld
4,863,089 A 9/1989 McCardle et al.
4,872,381 A * 10/1989 Stroms ..... 83/76.1
4,875,745 A 10/1989 Trulaske
4,909,419 A 3/1990 Yamada et al.
4,940,177 A 7/1990 Jimena
4,942,996 A 7/1990 Wolfberg et al.
4,946,087 A 8/1990 Wingert
5,004,141 A 4/1991 Young et al.
5,063,803 A * 11/1991 Panneri et al. ..... 83/203
5,207,679 A 5/1993 Li
5,239,904 A * 8/1993 Yamaguchi et al. ..... 83/210
5,240,161 A 8/1993 Kaneko
5,301,895 A 4/1994 Sheehan et al.
5,332,141 A 7/1994 Mukoyama et al.
5,522,533 A 6/1996 Mukoyama et al.
5,558,264 A 9/1996 Weinstein
5,634,582 A 6/1997 Morrison et al.
5,650,909 A 7/1997 Remele et al.
5,683,024 A 11/1997 Eminger et al.
5,697,541 A 12/1997 Burke et al.
5,738,266 A 4/1998 Ogawa
5,760,552 A 6/1998 Chen et al.
5,772,089 A 6/1998 Parsons et al.
5,772,098 A 6/1998 Crutcher
5,942,892 A 8/1999 Li
6,006,975 A 12/1999 Ishizawa
6,032,848 A 3/2000 Smolinski
6,041,992 A 3/2000 Poinelli et al.
6,095,393 A 8/2000 Smolinski
6,111,741 A 8/2000 Schmitz et al.
6,126,057 A 10/2000 Li
6,152,346 A 11/2000 Laubach
6,170,730 B1 1/2001 Lin
6,216,935 B1 4/2001 Oussani, Jr. et al.
6,264,193 B1 7/2001 Moeller
6,308,880 B1 10/2001 Ronconi
6,364,193 B1 4/2002 Tsai
6,400,046 B1 6/2002 Hwang et al.
6,422,447 B1 7/2002 White et al.
6,431,430 B1 8/2002 Jalbert et al.
6,499,642 B1 12/2002 Amada
6,598,777 B2 7/2003 Osuga et al.
6,650,091 B1 11/2003 Shiue et al.
6,655,572 B2 12/2003 Amada
6,688,510 B2 2/2004 Amada
6,742,691 B2 6/2004 Chen
6,753,673 B2 6/2004 Shiue et al.
6,796,477 B2 9/2004 Chen
6,830,173 B2 12/2004 Barber et al.
6,845,825 B2 * 1/2005 Bischel et al. ..... 175/24
6,854,530 B1 2/2005 Yiu
6,857,549 B1 2/2005 Chen
6,883,617 B2 * 4/2005 Putney et al. ..... 173/1
6,883,696 B1 4/2005 Steinbrunner et al.
6,905,056 B2 * 6/2005 Dittrich ..... 227/10
6,913,181 B2 7/2005 Mochizuki et al.
6,948,647 B1 9/2005 Niblett et al.
6,966,476 B2 11/2005 Jalbert et al.
7,048,170 B2 5/2006 Lin
7,057,870 B2 6/2006 Meyer et al.
7,063,247 B1 * 6/2006 Lund et al. ..... 227/10
7,099,136 B2 * 8/2006 Seale et al. ..... 361/152
7,137,186 B2 11/2006 Wojcicki et al.
7,225,962 B2 6/2007 Porth et al.
7,234,623 B2 6/2007 Li
7,312,972 B2 12/2007 Hourai et al.
7,349,193 B2 3/2008 Smith et al.
7,455,207 B2 11/2008 Wojcicki et al.
7,494,159 B2 2/2009 Sugino et al.
2002/0117531 A1 8/2002 Schell et al.
2005/0167465 A1 8/2005 Llewellyn
2005/0263559 A1 12/2005 Hagan et al.
2005/0263560 A1 12/2005 Niblett et al.
2006/0208027 A1 9/2006 Hagan
2007/0188967 A1 8/2007 Smith et al.
2007/0279011 A1 12/2007 Jones et al.

FOREIGN PATENT DOCUMENTS

DE 22 13 102 10/1972
DE 21 58 674 12/1975
DE 24 39 147 9/1977
DE 27 37 602 3/1979
DE 22 48 956 4/1981
DE 43 00 871 7/1994
EP 226027 6/1987
EP 0360573 3/1990

| | | |
|---|---|---|
| EP | 0726122 | 8/1996 |
| GB | 1402034 | 8/1975 |
| GB | 2002845 | 2/1979 |
| WO | WO 01/87545 | 11/2001 |
| WO | WO 02/14026 | 2/2002 |

* cited by examiner

MULTISTAGE SOLENOID FASTENING DEVICE

CROSS-REFERENCE TO RELATED APPLICATIONS

This application is a divisional of U.S. patent application Ser. No. 11/670,088 filed on Feb. 1, 2007. The entire disclosure of the above application is incorporated herein by reference.

FIELD

The present disclosure relates to a cordless fastening tool and more specifically relate to a method of extending and retracting a driver blade of the cordless fastening tool with a multistage solenoid and adjusting the magnetic fields of each of the stages of the multistage solenoid based on a position of the armature within the multistage solenoid.

BACKGROUND

Traditional fastening tools can employ pneumatic actuation to drive a fastener into a workpiece. In these tools, air pressure from a pneumatic system can be utilized to both drive the fastener into the workpiece and to reset the tool after driving the fastener. It will be appreciated that in the pneumatic system a hose and a compressor are required to accompany the tool. A combination of the hose, the tool and the compressor can provide for a large, heavy and bulky package that can be relatively inconvenient and cumbersome to transport. Other traditional fastening tools can be battery powered and can engage a transmission and a motor to drive a fastener. Inefficiencies inherent in the transmission and the motor, however, can limit battery life.

A solenoid has been used in fastening tools to drive fasteners. Typically, the solenoid executes multiple impacts on a single fastener to generate the force needed to drive the fastener into a workpiece. In other instances, corded tools can use a solenoid to drive the fastener but the energy requirements can be relatively large and are better suited to corded applications.

SUMMARY

A method of driving a fastener into workpiece generally includes retracting a trigger into a housing of the tool to execute a driver sequence and establishing a magnetic field in a multistage solenoid. The magnetic field is established in at least one of a first stage and a second stage. The method includes drawing an armature member to an extended condition from a retracted condition with the magnetic field and determining a position of the armature member relative to at least one of the first stage and the second stage. The method also includes directing power between the first stage and the second stage during the driver sequence based on the position of the armature member.

Further areas of applicability of the present teachings will become apparent from the detailed description provided hereinafter. It should be understood that the detailed description and specific examples, while indicating the various aspects of the present teachings, are intended for purposes of illustration only and are not intended to limit the scope of the teachings.

BRIEF DESCRIPTION OF THE DRAWINGS

The present teachings will become more fully understood from the detailed description, the appended claims and the accompanying drawings, which are each briefly described below.

DETAILED DESCRIPTION

The following description of the various aspects of the present teachings is merely exemplary in nature and is in no way intended to limit the teachings, their application or uses. As used herein, the term module and/or control module can refer to an application specific integrated circuit (ASIC), an electronic circuit, a processor (shared, dedicated, or group) and memory that executes one or more software or firmware programs, a combinational logic circuit, other suitable components and/or one or more suitable combinations thereof that provide the described functionality.

Figure 1:
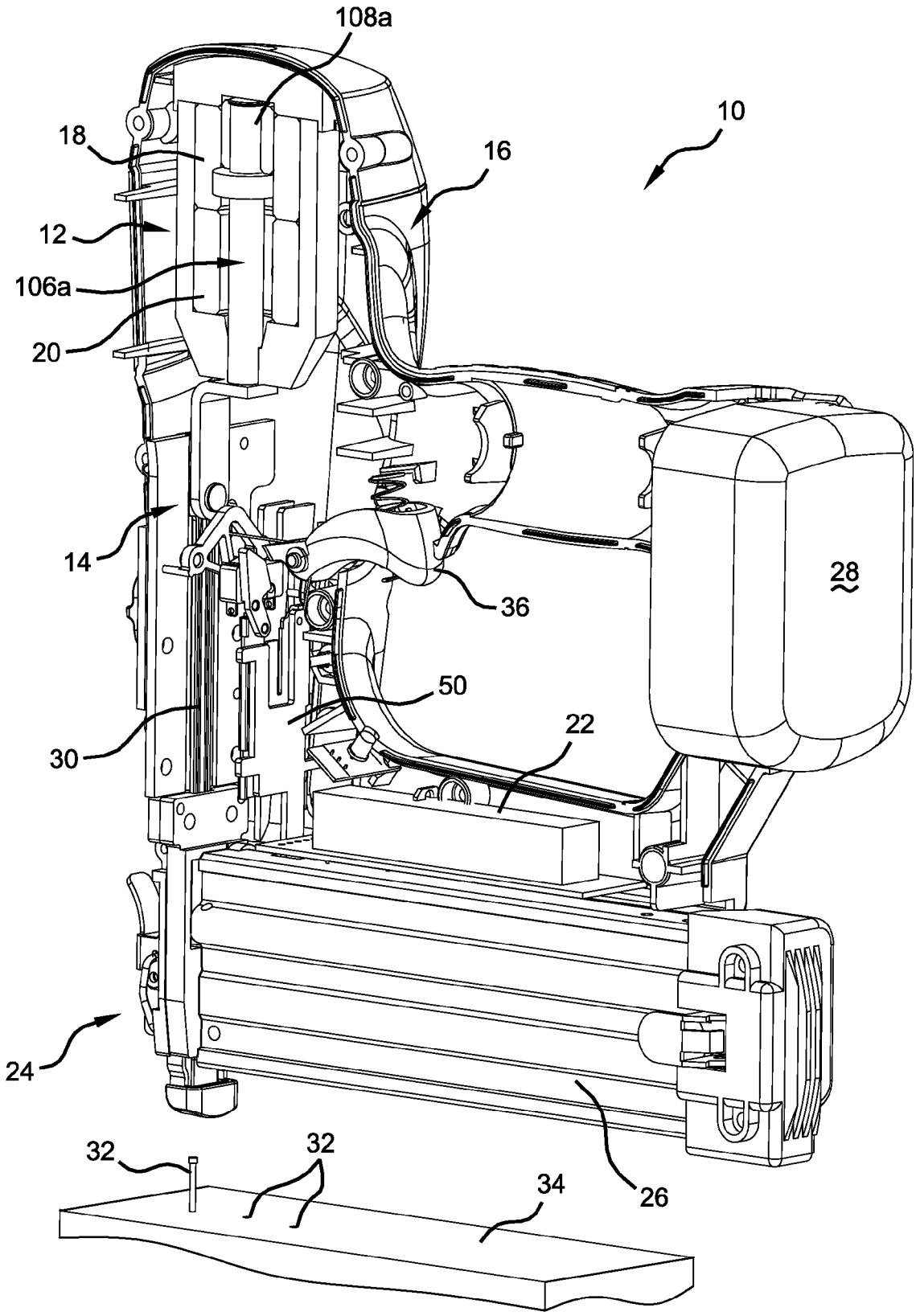
FIG. 1 is a perspective view of an exemplary cordless fastening tool having a multistage solenoid capable of inserting an exemplary fastener and an exemplary workpiece constructed in accordance with one aspect of the present teachings.

With reference to FIG. 1, an exemplary fastening tool 10 can include a multistage solenoid 12 that can drive a driver assembly 14 between a retracted condition (as shown in FIG. 1) and an extended condition (see, e.g., FIG. 2C) in accordance with one aspect of the present teachings. The fastening tool 10 can include an exterior housing 16, which can house a first stage 18 and a second stage 20 of the multistage solenoid 12. The exterior housing 16 can further contain the driver assembly 14 and a control module 22. While the multistage solenoid 12 is shown in FIG. 1 with the first stage 18 and the second stage 20, the multistage solenoid 12 can include additional stages in suitable implementations, examples of which are later described herein.

The exemplary fastening tool 10 can also include a nosepiece 24, a fastener magazine 26 and a battery 28. The fastener magazine 26 can be connected to the driver assembly 14, while the battery 28 can be coupled to the exterior housing 16. The control module 22 can control the first stage 18 and the second stage 20 to magnetically move the driver assembly 14 so that a driver blade 30 can drive one or more fasteners 32 into a workpiece 34 that are sequentially fed from the fastener magazine 26 when a trigger assembly 36 is retracted. The fasteners 32 can be nails, staples, brads, clips or any such suitable fastener 32 that can be driven into the workpiece 34.

Figure 2A:
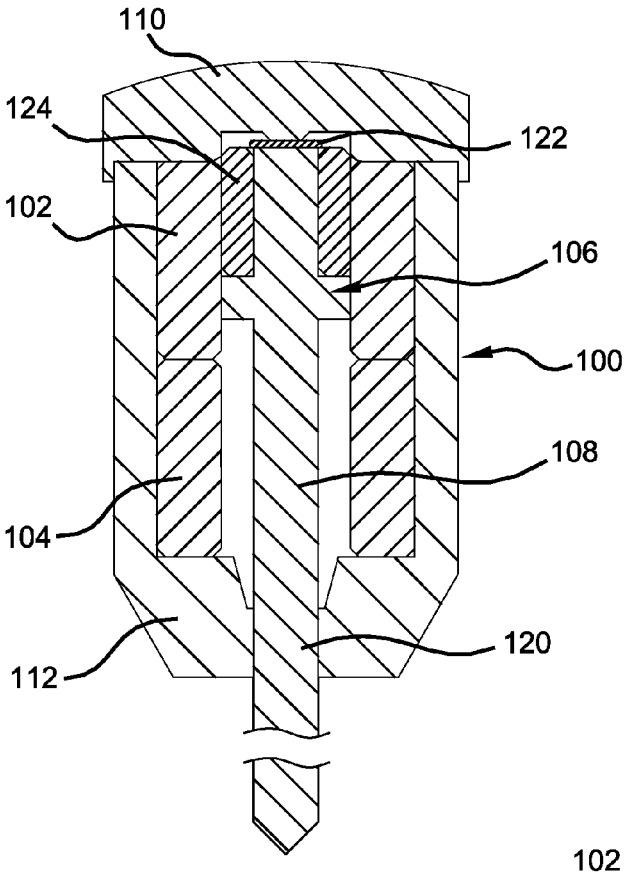
FIGS. 2A, 2B and 2C are diagrams showing a progression of an exemplary driver sequence of a multistage solenoid that extends a portion of a driver assembly from a retracted condition to an extended condition constructed in accordance with one aspect of the present teachings.
Figure 2B:
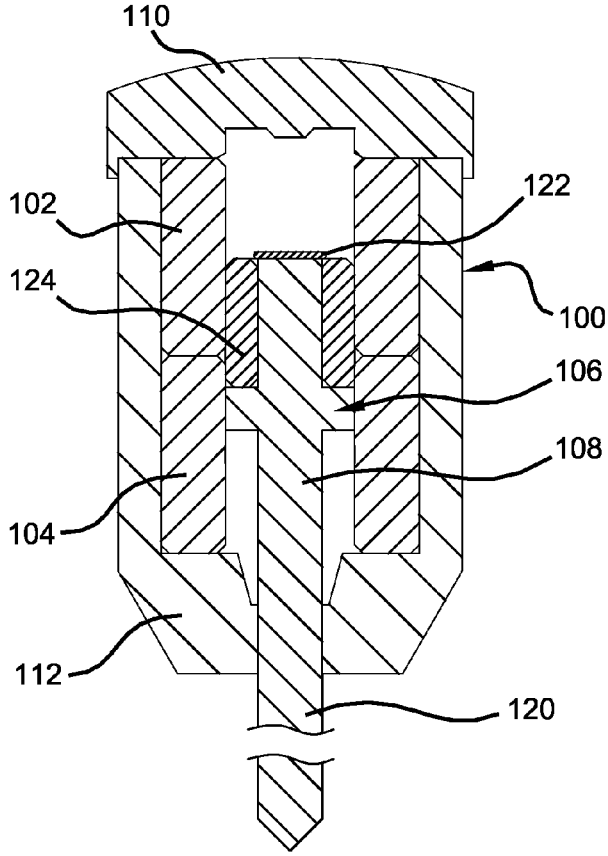
Figure 2C:
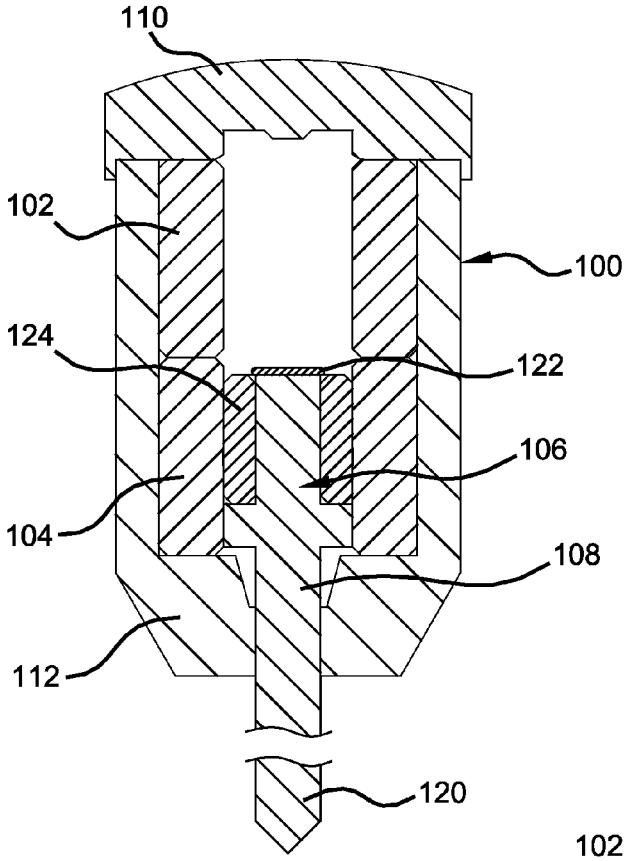

With reference to FIGS. 2A, 2B and 2C, a multistage solenoid 100 can include a first stage 102 and a second stage 104 that can each include one or more coil assemblies that can be selectively energized to establish a magnetic field and de-energized to collapse the magnetic field in accordance with one aspect of the present teachings. By selectively energizing and de-energizing the first stage 102 and/or the second stage 104, the one or more magnetic fields can establish a generally linear motion of an armature member 106 that moves relative to the stages 102, 104. In one example, the magnetic fields can be selectively energized or collapsed to relatively efficiently drive the one or more fasteners 32 (FIG. 1). The multistage solenoid 100, however, can save (i.e., not expend) the energy to maintain the magnetic fields by collapsing the magnetic fields at predetermined times and/or locations of the armature member 106 relative to stages 102, 104.

The armature member 106 can define (wholly or partially) a plunger member 108 that can move from a retracted condition (FIG. 2A) to an extended condition (FIG. 2C). In FIG. 1, the driver assembly 14 can include the driver blade 30 that can be connected to a plunger member 108*a* via a link member 38. The plunger member 108*a* can define (wholly or partially) an armature member 106*a* associated with the multistage solenoid 12. In other examples, additional link members can connect the driver blade 30 to the plunger member 108*a* or the plunger member 108*a* can also be directly coupled to the driver blade 30.

Returning to FIGS. 2A, 2B and 2C, the plunger member 108 can travel between a top stop 110 and a bottom stop 112. A portion of the plunger member 108 can define a driver blade 120, when applicable. The top stop 110 and/or the bottom stop 112 can be a portion of the stages 102, 104, an interior portion of the exterior housing 16 (FIG. 1), a separate component connected to the interior portion of the exterior housing 16 and/or the stages 18, 20, and/or one or more combinations thereof. In any of the above configurations, the driver blade 120 can extend beyond the bottom stop 112.

In various aspects of the present teachings, the driver assembly 14 can cycle through a driver sequence that can drive the fastener 32 into the workpiece 34, as shown in FIG. 1. With reference to FIG. 2A, the driver sequence can begin, for example, with the plunger member 108 in the retracted condition. The first stage 102 and the second stage 104 can be energized to establish the respective magnetic fields to draw the plunger member 108*a* (i.e., the armature member 106) toward the second stage 104. When the plunger member 108 is connected to a driver blade 120, the driver blade 120 can begin to move from a retracted condition to an extended condition. The plunger member 108 can end its motion at or near the bottom stop 112.

To return the plunger member 108 to the retracted condition, the first stage 102 and/or the second stage 104 can be energized but the direction of the magnetic field can be reversed so as to reverse the direction of the magnetic force applied to the plunger member 108. For example, the plunger member 108*a*, in FIG. 1, can return the driver blade 30 to the retracted condition from the extended condition. As shown in FIGS. 2A, 2B and 2, the armature member 106 can further define a core member 124 that can be secured to the plunger member 108 with a cap member 122. In one aspect of the present teaching the cap member 122 and/or the core member 124 can be included, while in other aspects of the present teaching the cap member 122 and/or the core member 124 can be omitted.

As the plunger member 108 travels between the stages 102, 104, the respective magnetic fields can be energized or collapsed accordingly to facilitate the motion of the plunger member 108 through the driver sequence and conserve energy consumption during such motion. Specifically, a position of the plunger member 108 (i.e., the armature member 106) can be determined relative to the stages 102, 104 by detecting, for example, a change in current. The change in current can be caused by a change in inductance of one or more coil circuits in one or more coil assemblies that can be associated with one or more of the stages 102, 104. Specifically, this change in inductance affects the resistance of the one or more coil circuits in the one or more coil assemblies, which can ultimately be measured as a change in current associated with a respective coil circuit.

Figure 7:
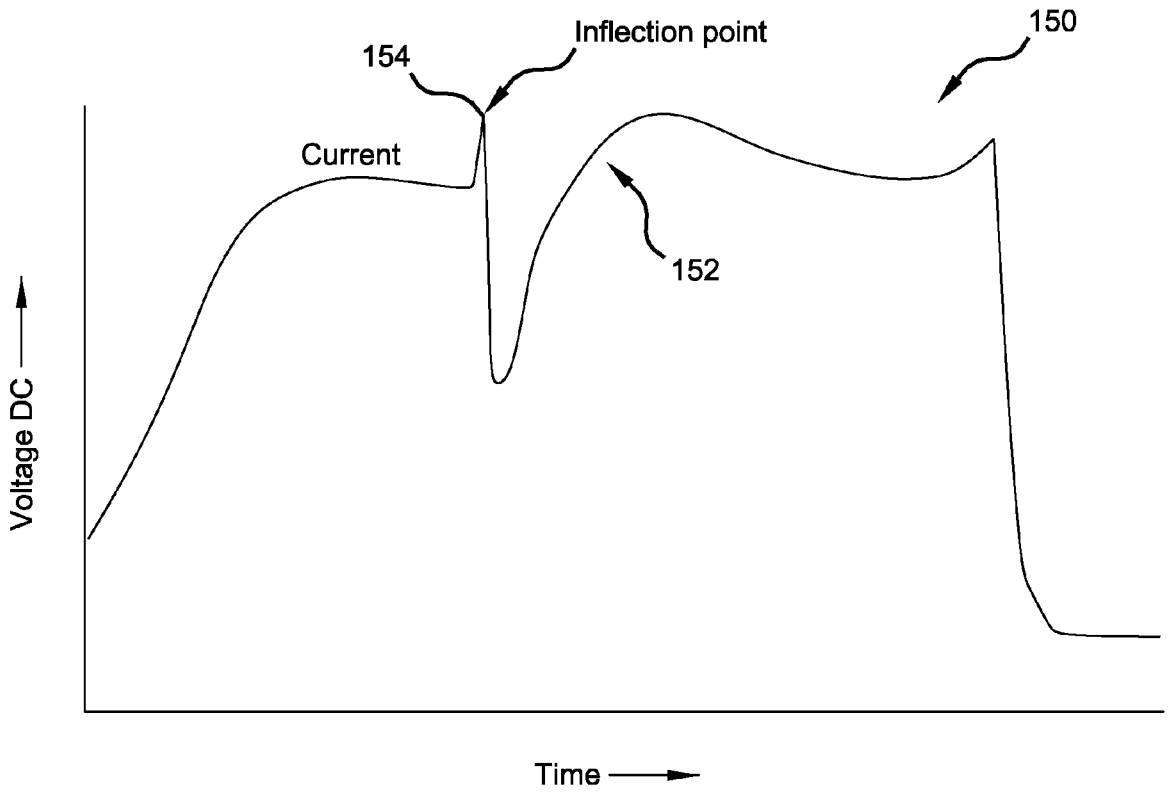
FIG. 7 is a diagram of a value of current used by the multistage solenoid and shows an inflection point of the value of current associated with a stage in the multistage solenoid in accordance with one aspect of the present teachings. The value of current is shown as a function of voltage and time.

In one aspect of the present teachings and with reference to FIG. 7, a diagram 150 shows a value of current 152 as a function of time and direct current voltage. A current inflection point 154 can be detected and can serve as a proxy for the position of the armature member 106 (FIG. 2) in the multistage solenoid 100 (FIG. 2). When the first inflection point 154 is detected, the control module 22 (FIG. 1) can direct full power from the first stage 102 (FIG. 2) to the second stage 104 (FIG. 2). It will be appreciated in light of the disclosure that when a multistage solenoid having more than two stages, see, e.g., FIG. 4, the direction of full power between the stages based on the detection of the inflection point can be repeated as the armature member 106 travels between the stages. Regardless of the amount of stages, the control module 22 can direct full power to each stage and switch power between the stages based on the position of the armature member 106 without the need to modulate the power with, for example, pulse width modulation.

The detection of the inflection point 154 can be based on detection of a threshold change of rate of a value of current. By detecting the threshold change of a value of a rate of a current, the control module 22 (FIG. 1) can account for relative changes in voltage due to, for example, changes in remaining battery life and changes in ambient conditions such as ambient temperature. The inflection point can also define a point where the value of the change of rate of current, as illustrated in FIG. 7, changes from a positive value to a negative value or vice versa, i.e., the concavity of the slope changes. In this instance, the control module 22 can specifically determine when the value of the rate of change of the value of current changes from a positive value to a negative value, as shown at the inflection point 154. Put another way, the control module 22 detects the value of the second derivative of current of a period of time, such that when the value of the second derivative becomes negative, the control module can direct power to the subsequent stage.

Figure 3:
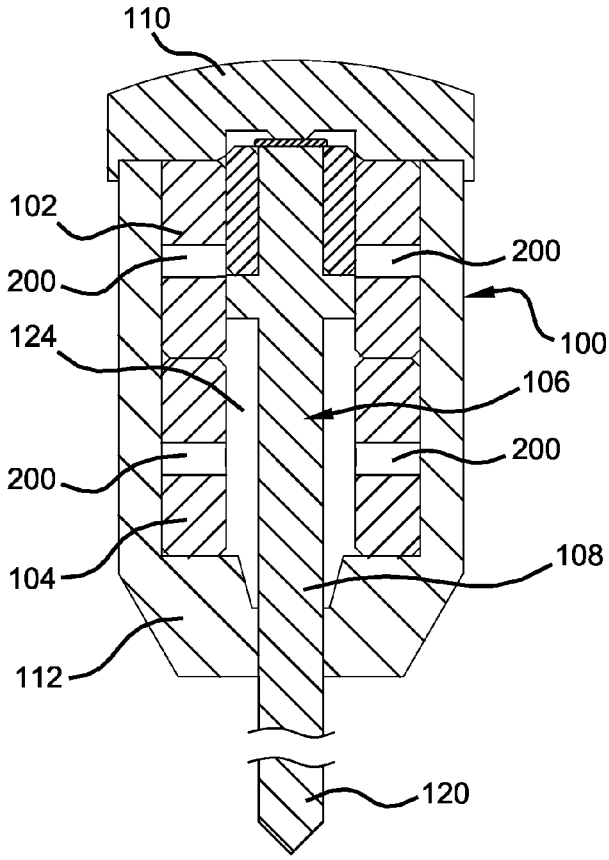
FIG. 3 is a diagram of a multistage solenoid having sensors that detect a position of a plunger relative to the stages constructed in accordance with one aspect of the present teachings.

In one aspect of the present teaching and with reference to FIG. 3, one or more sensors 200 can be used to detect the position of the armature member 106 relative to the stages 102, 104 in the multistage solenoid 100. In doing so, the position and/or velocity of the armature member 106 and the energizing and collapsing of magnetic fields of the stages 102, 104 can be tuned (i.e., adjusted) to further conserve energy and/or increase a force produced by the multistage solenoid 100.

Figure 4:
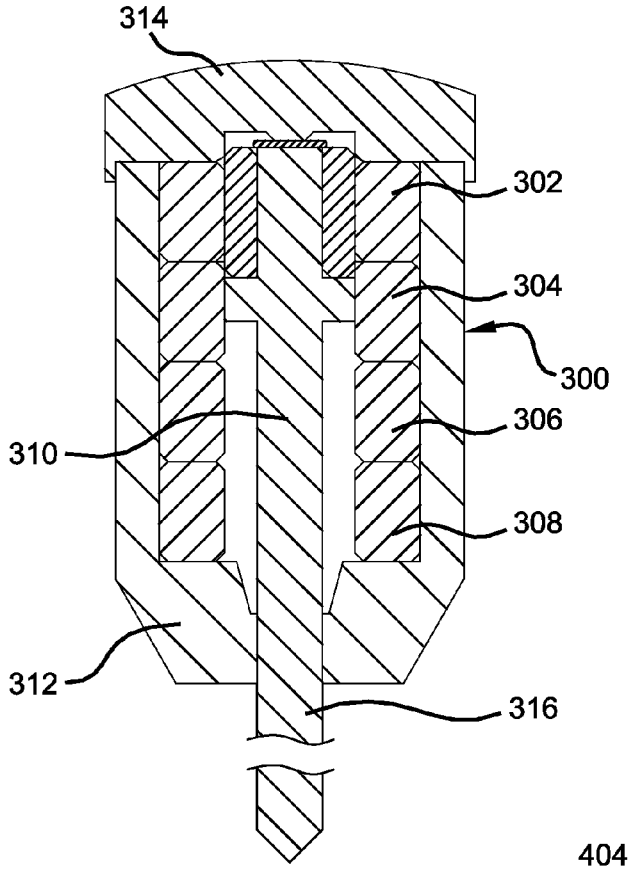
FIG. 4 is a diagram of a multistage solenoid having four stages constructed in accordance with one aspect of the present teachings.

In a further aspect of the present teachings and with reference to FIG. 4, a multistage solenoid 300 can include more than two stages: a first stage 302, a second stage 304, a third stage 306 and a fourth stage 308. As a plunger member 310 (i.e., an armature 312) is drawn from a retracted condition to an extended condition (not specifically shown), each of the stages 302, 304, 306, 308 can be energized and de-energized in a cascading fashion. To this end, the plunger member 310 can be continuously accelerated toward the next stage (e.g., the second stage 304 to the third stage 306) until the travel of the plunger member 310 terminates in the extended condition and/or a portion of the plunger member 310 contacts a second stop 312 that resides on an opposite side of the multistage solenoid 300 from a first stop 314. The plunger member 310 can define a driver blade 316 or can connect thereto in various suitable fashions. From the extended condition, each of the stages 302, 304, 306, 308 can be energized and then de-energized in a similar but reverse cascading fashion to draw the plunger member 310 from the extended condition back to the retracted condition, as shown in FIG. 4. A spring or other suitable elastic member can also be used to move (partially or wholly) the plunger member 310 from the extended condition to the retracted condition, as discussed in greater detail below.

Figure 5:
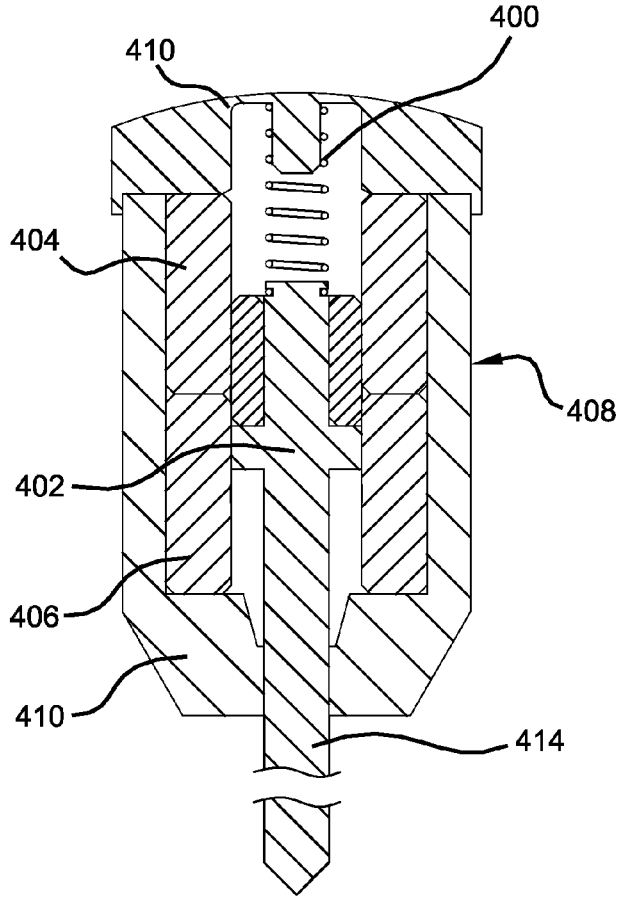
FIG. 5 is a diagram showing a spring member connected to a plunger of a multistage solenoid that returns the plunger to the retracted condition from the extended condition constructed in accordance with one aspect of the present teachings.

In accordance with yet another aspect of the present teachings and with reference to FIG. 5, a spring 400 or other suitable elastic member can be attached to a portion of a plunger member 402. The spring 400 can hold the plunger member 402 in a retracted condition (see, e.g., FIG. 6A) and, when applicable, urge the plunger member 402 to return to the retracted condition from an extended condition (see, e.g., FIG. 6B). It will be appreciated in light of the disclosure that a first stage 404 and/or a second stage 406 of a multistage solenoid 408, when energized, can hold the plunger member 402 in the retracted condition. In this example, the spring 400 can, in combination with the first stage 404 and/or the second stage 406 (or by itself), also hold the plunger member 402 in the retracted condition.

When the second stage 406 is energized and draws the plunger member 402 toward a second stop 410 and into the extended condition (not specifically shown), the spring 400 can be elongated and thus produce a spring force that can act to return the plunger member 402 to the retracted condition. As the second stage is de-energized, the spring 400 can begin to pull the plunger member 402 toward a first stop 412 and into the retracted condition. In this case, not only does the magnetic field generated by the first stage 404 and/or the second stage 406 draw the plunger member 402 back to the retracted condition, the spring force generated by the spring 400 in the elongated condition can also draw the plunger member 402 back to the retracted condition.

The plunger member 402 can define a driver blade 414. It will be appreciated in light of the disclosure that the first stage 404 and/or the second stage 406 need not be used in lieu of using the spring 400 or other suitable elastic member to return the plunger member 402 back to the retracted condition. Because the first stage 404 and/or the second stage 406 need not be energized (or a field generated by the first stage 404 and/or the second stage 406 need not be as strong) to move the plunger member 402 to the retracted condition, battery life can be extended.

Figure 6A:
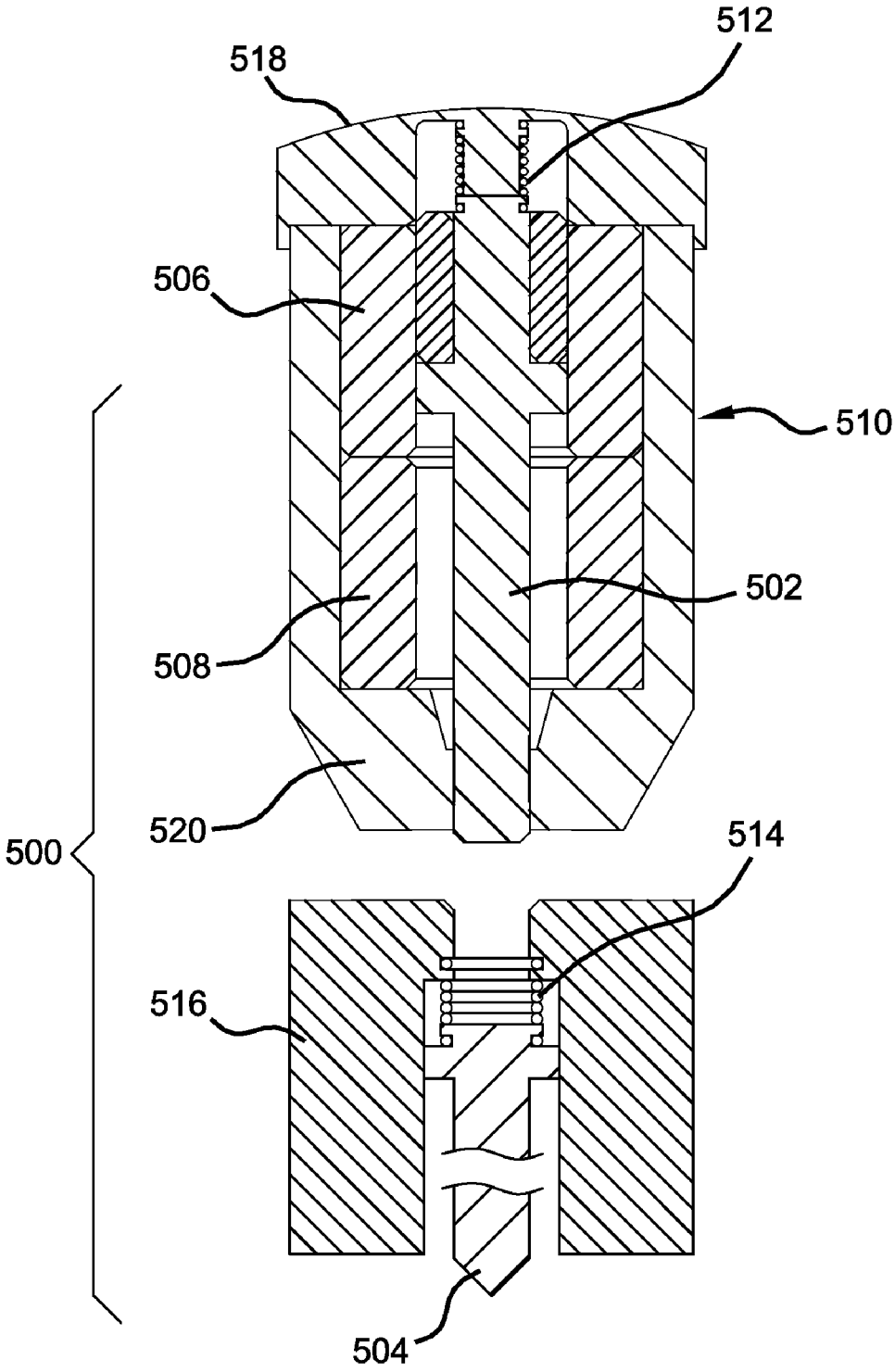
FIGS. 6A, 6B and 6C are diagrams of a driver sequence of a multistage solenoid with a plunger having a return spring that extends to contact a separate driver blade that also has a return spring constructed in accordance with one aspect of the present teachings.
Figure 6B:
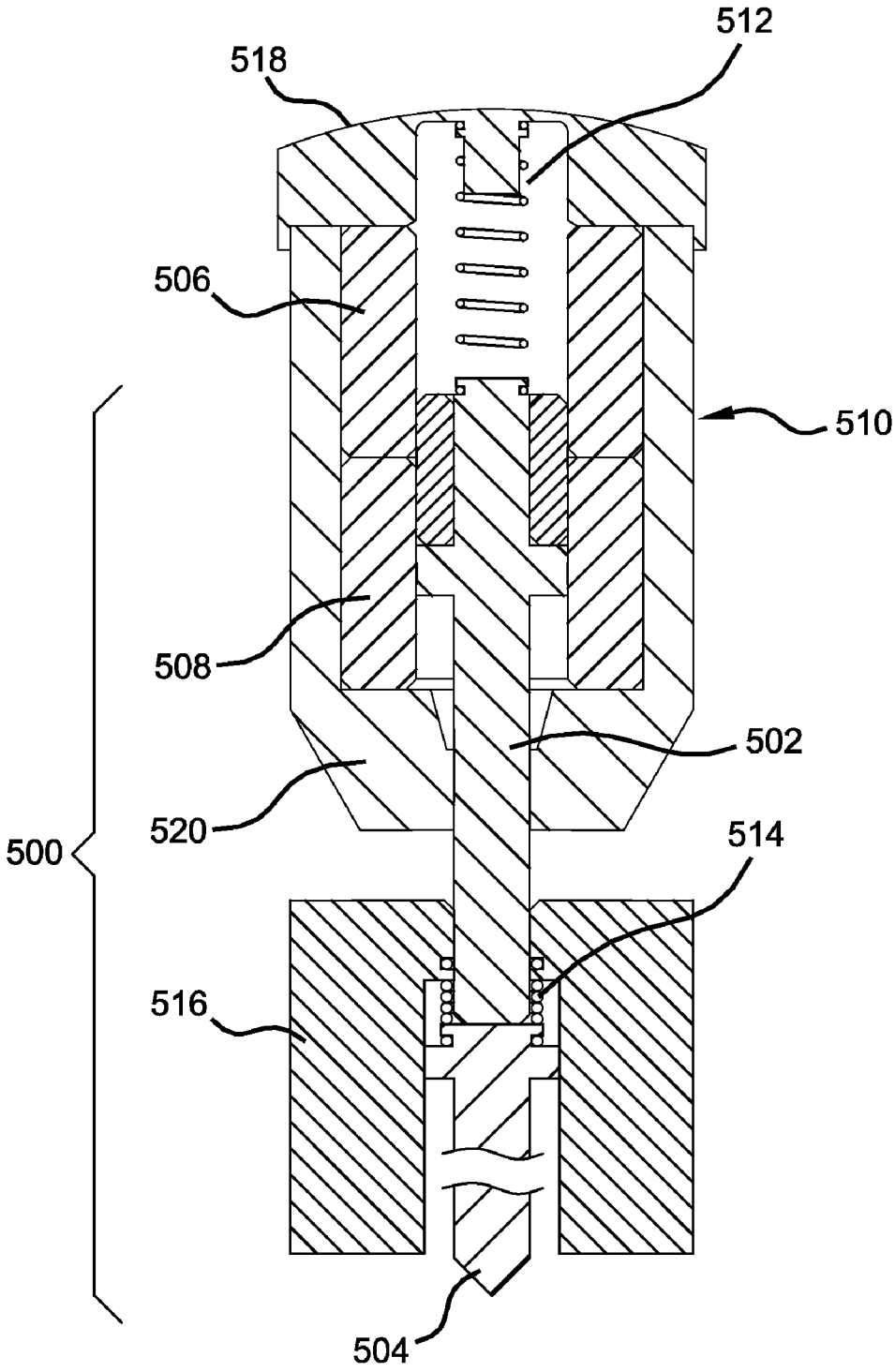
Figure 6C:
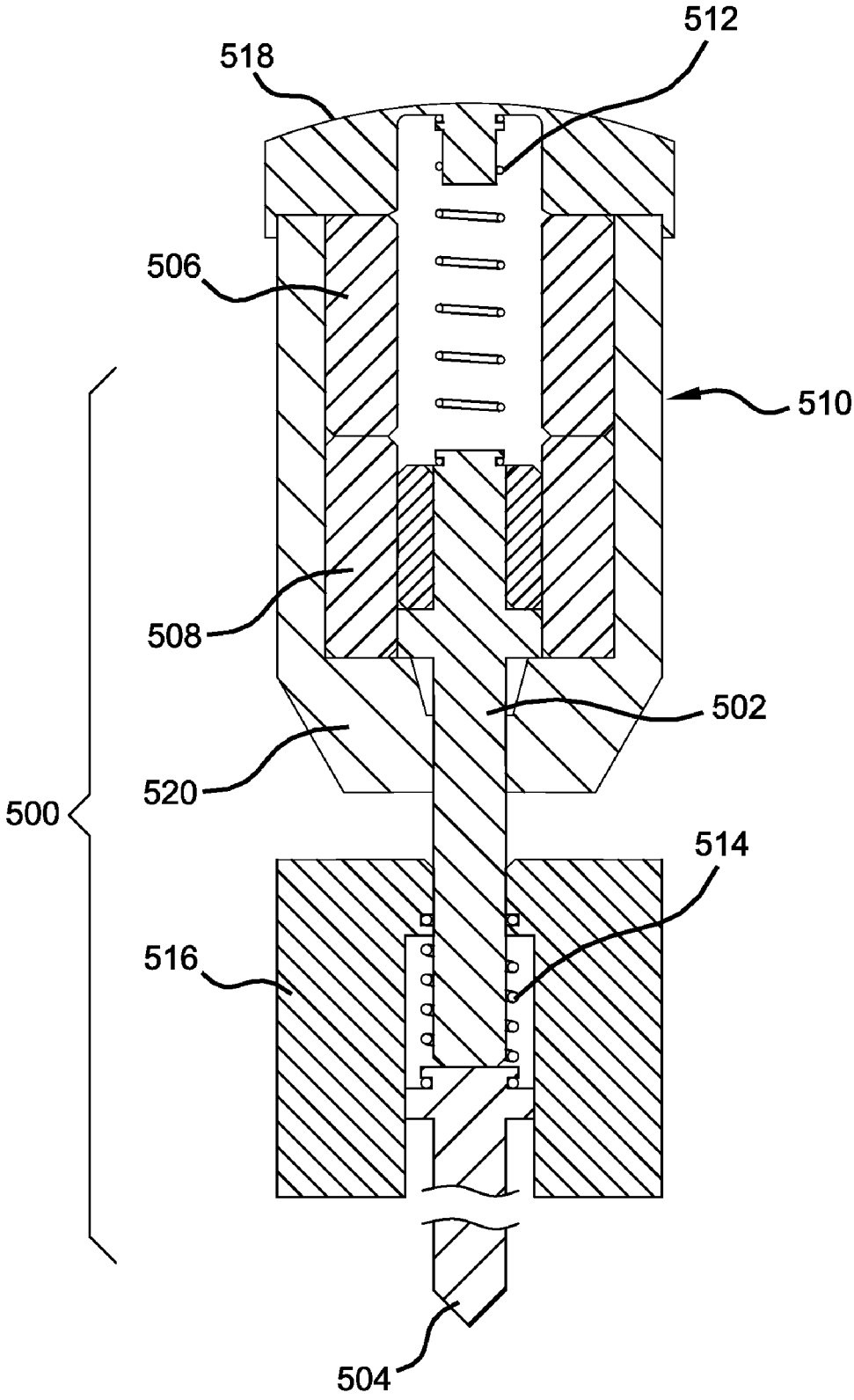

In another aspect of the present teachings and with reference to FIGS. 6A, 6B and 6C, a driver assembly 500 can include a two-piece assembly. Specifically, the driver assembly 500 can include a plunger member 502 that can move independently of a driver blade member 504. The plunger member 502 can be moved between an extended condition (FIG. 6C) and a retracted condition (FIG. 6A) by energizing and de-energizing at least a first stage 506 and/or a second stage 508 of a multistage solenoid 510. The plunger member 502, when moved from the retracted condition to the extended condition by one or more of the stages 506, 508 can strike and, therefore, impart a force on the driver blade member 504. The force from the plunger member 502 can move the driver blade member 504 from a retracted condition (FIG. 6A) to an extended condition (FIG. 6C) to, for example, drive a fastener into a workpiece in a similar fashion to the driver blade 30, as shown in FIG. 1.

A spring 512 or other elastic member can be attached to the plunger member 502 and a portion of a first stop 518 and can assist with the movement of the plunger member 502 from the extended condition (FIG. 6C) back to the retracted condition (FIG. 6A). In addition, a spring 514 or other suitable elastic member can be attached to the driver blade member 504 and a block member 516. In one example, the block member 516 can be contained with a suitable tool housing. The spring 514 attached to the driver blade member 504 can move the driver blade member 504 from the extended condition (FIG. 6C) back to the retracted condition (FIG. 6A).

The first stage 506 and/or the second stage 508 can be energized to draw the plunger member 502 from the retracted condition to the extended condition. As the plunger member 502 is drawn toward the second stage 508, the plunger member 502 can strike the driver blade member 504 to move the driver blade member 504 from the retracted condition to the extended condition. It will be appreciated in light of this disclosure that the larger the velocity achieved by the plunger member 502, the larger amount of energy (e.g., an impulsive force) that is delivered to the driver blade member 504.

From the extended condition, the spring 514 or the suitable elastic member can pull the driver blade member 504 back to the retracted condition. After the plunger member 502 has imparted the force on the driver blade member 504, the stages 506, 508 can be energized to draw the plunger member 502 back to the retracted condition. In lieu of, or in addition to, the magnetic force of the stages 506, 508 the springs 512, 514 or other suitable elastic member can (wholly or partially) draw the plunger member 502 and/or the driver blade member 504 back from the extended condition to the retracted condition.

As noted, the two or more stages of the multistage solenoid can be energized in a cascading fashion to move a driver assembly that can have a driver blade in a similar fashion to an electric motor and a transmission. When compared to the electric motor and the transmission, however, the multistage solenoid can be shown to provide relatively better battery life. In addition, the fastening tool using the multistage solenoid can provide a relatively lighter, more balanced and more compact tool.

With reference to FIG. 1, the nosepiece 22 can include a contact trip mechanism 50 as is known in the art. Briefly, the contact trip mechanism 50 can be configured to prevent the fastening tool 10 from driving the fastener 32 into the workpiece 34 (e.g., inhibit power to the multistage solenoid) unless the contact trip mechanism 50 is in contact with the workpiece 34 (i.e., in a retracted position).

With the contact trip mechanism 50 in a retracted condition, the trigger assembly 36 can be retracted to initiate the driver sequence. Further details of an exemplary contact trip mechanism are disclosed in commonly assigned United States patent applications entitled Operational Lock and Depth Adjustment for Fastening Tool, filed Oct. 29, 2004, Ser. No. 10/978,868; Cordless Fastening Tool Nosepiece with Integrated Contact Trip and Magazine Feed, filed Oct. 29, 2004, Ser. No. 10/878,867; and U.S. Pat. No. 6,971,567, entitled Electronic Control Of A Cordless Fastening Tool, issued Dec. 26, 2005, which are hereby incorporated by reference as if fully set forth herein.

Figure 8:
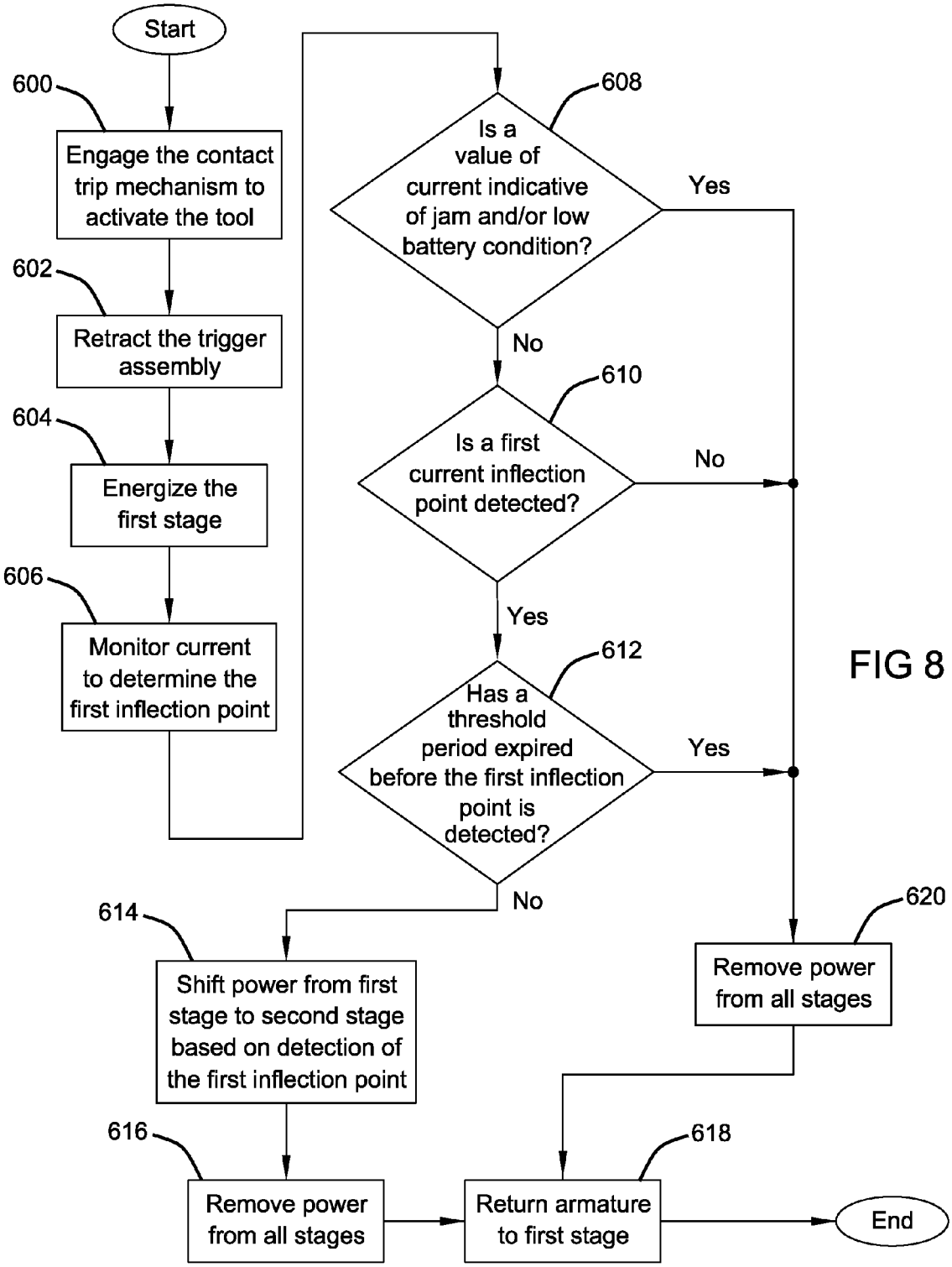
FIG. 8 is a flowchart of an exemplary method of use of the multistage solenoid in a fastening tool in accordance with another aspect of the present teachings.

In one aspect of the present teachings and with reference to FIG. 8, an exemplary method is illustrated in a flow chart that can be used with the multistage solenoid 100 and, for example, the fastening tool 10 having the multistage solenoid 12 that drives the driver assembly 14, as shown in FIG. 1. In 600, the contact trip mechanism 50 (FIG. 1) associated with the fastening tool 10 is engaged, e.g., retracted against the workpiece 34 (FIG. 1). In 602, a user can retract the trigger assembly 36. Upon detecting the retraction of the trigger assembly 36, the control module 22 can direct power to the first stage 18. In 604, the first stage is energized and can establish a magnetic field that can exert a force on the armature member 106*a* (FIG. 1). In 606, the control module 22 can monitor the value of the current over time to determine when a value of the current establishes an inflection point.

In 608, while the control module 22 is watching for the current inflection point, the control module 22 (FIG. 1) can determine whether the value of current is indicative of a tool jam condition and/or a low battery condition. In one example, the value of current can be relatively higher when the tool jam condition and/or the low battery condition occur. When the value of current is indicative of the tool jam condition and/or the low battery condition, the method continues at 620. When the value of current is not indicative of a tool jam condition and/or a low battery condition, the method continues at 610.

In 610, the control module 22 (FIG. 1) can determine whether the current inflection point has been detected. When the control module 22 detects the current inflection point, the method continues at 612. When the control module 22 does not detect the current inflection point, the method continues at 620. In 612, the control module 22 can determine whether a threshold period of time has expired before the detection of the current inflection point. When the control module 22 detects the current inflection point before the expiration of the threshold period of time, the method continues at 614. When the control module 22 detects the current inflection point after the expiration of the threshold period of time, the method continues at 620.

In 614, the control module 22 (FIG. 1) can shift power from the first stage 18 (FIG. 1) to the second stage 20 (FIG. 1) based on the detection of the first inflection point. It will be appreciated in light of the disclosure that in an instance where the multistage solenoid 12 (FIG. 1) has more than two stages, the method can loop back to 606 and wait to detect a second inflection point. When the second inflection point is detected, the control module 22 can send power from the second stage to a third stage of the multistage solenoid. This can continue until power is sent to the last stage of the multistage solenoid 12.

In 616, the control module 22 (FIG. 1) can remove power from all of the stages, so that each stage is not applying a force to the armature member 106*a* (FIG. 1). In 618 and with reference to FIG. 1, a suitable return spring or other suitable mechanism can return the driver assembly 14 to the retracted condition, i.e., returning the armature member 106*a* to the first stage 18. It will be appreciated in light of the disclosure that the fields generated by the stages of the multistage solenoid 12 can be reversed to direct the armature member 106*a* (FIG. 1) in a direction opposite, as discussed above, to return the driver assembly 14 to the retracted or beginning condition.

Returning to FIG. 8, the control module 22 (FIG. 1), in 620, can remove power from all of the stages, so that each stage does not apply a force to the armature member 106*a* (FIG. 1). From 618 and from 620, the method ends.

While specific aspects have been described in the specification and illustrated in the drawings, it will be understood by those skilled in the art that various changes can be made and equivalents can be substituted for elements thereof without departing from the scope of the present teachings. Furthermore, the mixing and matching of features, elements and/or functions between various aspects of the present teachings may be expressly contemplated herein so that one skilled in the art will appreciate from the present teachings that features, elements and/or functions of one aspect of the present teachings may be incorporated into another aspect, as appropriate, unless described otherwise above. Moreover, many modifications may be made to adapt a particular situation, configuration or material to the present teachings without departing from the essential scope thereof. Therefore, it is intended that the present teachings not be limited to the particular aspects illustrated by the drawings and described in the specification as the best mode presently contemplated for carrying out the present teachings but that the scope of the present teachings includes many aspects and examples following within the foregoing description and the appended claims.

What is claimed is:

1. A method of driving a fastener into a workpiece by executing a driver sequence with a control module in a portable tool, the method comprising:

retracting a trigger into a housing of the portable tool to execute the driver sequence;

establishing a magnetic field in a multistage solenoid with the control module in at least one of a first stage and a second stage;

drawing an armature member to an extended condition from a retracted condition with said magnetic field;

determining a position of said armature member with the control module relative to at least one of said first stage and said second stage;

directing power between said first stage and said second stage with the control module during the driver sequence based on said position of said armature member.

2. The method of claim 1 wherein said determining of said position of said armature member includes determining a change in a current associated with at least one of said first stage and said second stage, said change in said current being caused by a change in an inductance of a circuit associated with at least one of said first stage and said second stage.

3. The method of claim 1 wherein said determining of said position of said armature member includes detecting a current inflection point associated with at least one of said first stage and said second stage.

4. The method of claim 1 wherein said determining of said position of said armature member includes communicating with one or more sensors on said multistage solenoid that detect said position of said armature member.

5. The method claim 1 further comprising moving a driver blade member with said armature member from said retracted condition to said extended condition with said multistage solenoid, said driver blade member in said extended condition operable to drive the fastener.

6. The method of claim 1 further comprising striking a portion of said driver blade member with said armature member to move said driver blade member from said retracted condition to said extended condition.

7. The method of claim 1 further comprising moving said armature members from said extended condition to said retracted condition with a force generated by a spring member and without a force generated by said multistage solenoid.

8. A method of driving a fastener into a workpiece by executing a driver sequence with a control module to establish a magnetic field in a multistage solenoid in a portable tool, the method comprising:

positioning an armature that is connected to a driver blade in the multistage solenoid having at least a first stage and a second stage, the control module moves said driver blade and said armature between a retracted condition and an extended condition;

engaging a contact trip mechanism of the portable tool;

retracting a trigger into a housing of the portable tool to execute the driver sequence;

establishing the magnetic field in a first stage of the multistage solenoid with the control module when said contact trip mechanism is engaged and said trigger is retracted;

moving said armature member toward said extended condition from said retracted condition with the magnetic field of said first stage;

determining a position of said armature member with the control module relative to said first stage and said second stage;

directing power from said first stage to said second stage to establish the magnetic field in said second stage with the control module during the driver sequence based on said position of said armature member;

collapsing the magnetic field in said first stage;

drawing said armature member to said extended condition, said driver blade in said extended condition operable to drive the fastener.

9. The method of claim 8 further comprising:

reversing the magnetic field in said second stage;

moving said armature member toward said retracted condition from said extended condition with the magnetic field of said second stage;

directing power from said second stage to said first stage to establish the magnetic field in said first stage during the driver sequence based on said position of said armature member;

collapsing the magnetic field of said second stage;

drawing said armature member to said retracted condition.

10. The method of claim 8 further comprising:

collapsing the magnetic field of said second stage;

moving said armature member from said extended condition to said retracted condition with a force generated by a spring member.

11. The method of claim 8 wherein said determining of said position of said armature member includes determining a change in a current associated with at least one of said first stage and said second stage, said change in current being caused by a change in an inductance of a circuit associated with said at least one of said first stage and said second stage.

12. The method of claim 8 wherein said determining of said position of said armature member includes detecting a current inflection point associated with at least one of said first stage and said second stage.

13. The method of claim 8 wherein said determining of said position of said armature member includes communicating with one or more sensors on the multistage solenoid that detect said position of said armature member.

14. The method of claim 8 further comprising striking a portion of said driver blade member with said armature member to move said driver blade member from said retracted condition to said extended condition.

15. A method of driving a fastener into a workpiece by executing a driver sequence with a control module to establish a magnetic field in a multistage solenoid in a portable tool, the method comprising:

positioning an armature that is connected to a driver blade member in the multistage solenoid having at least a first stage and a second stage;

engaging a contact trip mechanism on the portable tool;

retracting a trigger into a housing to execute the driver sequence;

determining whether a value of current delivered to the multistage solenoid is indicative of said driver blade member being unable to move between a retracted condition and an extended condition;

establishing the magnetic field in said first stage when the control module determines whether said contact trip mechanism is engaged, said trigger is retracted, and said value of current delivered to the multistage solenoid is indicative of said driver blade member being to move;

drawing an armature member toward an extended condition from a retracted condition with the magnetic field established by the control module in said first stage;

determining when a value of a rate of change of current at said first stage changes from being positive to being negative;

collapsing said magnetic field in said first stage and establishing a magnetic field in said second stage when the control module determines whether said value of said rate of change of said current changes from said positive value to said negative value.

16. The method of claim 15 further comprising:

reversing the magnetic field in said second stage;

moving said armature member toward said retracted condition from said extended condition with the magnetic field established by the control module in said second stage;

determining when a value of a rate of change of current at said second stage changes from being positive to being negative;

collapsing said magnetic field in said second stage and establishing a magnetic field in said first stage when the control module determines whether said value of said rate of change of said current at said second stage changes from said positive value to said negative value.

17. The method of claim 15 further comprising:

collapsing the magnetic field of said second stage;

moving said armature member from said extended condition to said retracted condition with a force generated by a spring member.

* * * * *

UNITED STATES PATENT AND TRADEMARK OFFICE

CERTIFICATE OF CORRECTION

PATENT NO. : 7,665,540 B2
APPLICATION NO. : 12/402974
DATED : February 23, 2010
INVENTOR(S) : Paul G. Gross et al.

It is certified that error appears in the above-identified patent and that said Letters Patent is hereby corrected as shown below:

Column 1, line 17, "relate" should be --relates--.

Column 1, line 51, after "into", insert --a--.

Column 8, line 59, after "method", insert --of--.

Column 10, line 27, after "being", insert --able--.

Signed and Sealed this

First Day of June, 2010

David J. Kappos

David J. Kappos
*Director of the United States Patent and Trademark Office*